US009643772B2

(12) United States Patent
Yue et al.

(10) Patent No.: US 9,643,772 B2
(45) Date of Patent: May 9, 2017

(54) PACKAGE BOX DEVICE FOR LIQUID CRYSTAL PANELS

(71) Applicant: SHENZHEN CHINA STAR OPTOELECTRONICS TECHNOLOGY CO., LTD., Shenzhen (CN)

(72) Inventors: Liang Yue, Shenzhen (CN); Yu Chun Hsiao, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 14/417,352

(22) PCT Filed: Jul. 17, 2014

(86) PCT No.: PCT/CN2014/082373
§ 371 (c)(1),
(2) Date: Jan. 26, 2015

(87) PCT Pub. No.: WO2016/000279
PCT Pub. Date: Jan. 7, 2016

(65) Prior Publication Data

US 2016/0001964 A1 Jan. 7, 2016

(30) Foreign Application Priority Data

Jul. 4, 2014 (CN) ..... 2014 1 0318382

(51) Int. Cl.
*B65D 85/48* (2006.01)
*B65D 25/10* (2006.01)

(52) U.S. Cl.
CPC ..... *B65D 85/48* (2013.01); *B65D 25/10* (2013.01)

(58) Field of Classification Search
USPC ..... 206/454, 455, 456, 701, 722, 723, 586, 206/594
See application file for complete search history.

(56) References Cited

U.S. PATENT DOCUMENTS 6,273,261 B1 * 8/2001 Hosoi ..... H01L 21/67294 206/459.5
6,412,635 B1 * 7/2002 Lu ..... B65D 81/113 206/523

(Continued)

FOREIGN PATENT DOCUMENTS

CN 201545373 U 8/2010
CN 102849351 A 1/2013

(Continued)

OTHER PUBLICATIONS

Office Action issued on Oct. 29, 2015, by the State Intellectual Property Office of China in corresponding Chinese Patent Application No. 201410318382.2. (6 pages).

(Continued)

*Primary Examiner* — Jacob K Ackun
(74) *Attorney, Agent, or Firm* — Buchanan Ingersoll & Rooney PC

(57) ABSTRACT

The present disclosure discloses a package box device for liquid crystal panels, comprising a rectangular box for accommodating liquid crystal panels, wherein an inside surface of said rectangular box is an inclined inside surface, and an inside surface opposite to said inclined inside surface of said rectangular box is provided with a detachable member; and wherein said detachable member is constructed so that after said detachable member is installed, said detachable member protrudes toward said inclined inside surface to fix liquid crystal panels to be transported; and after said detachable member is detached, the upper opening of said rectangular box becomes larger to facilitate removal of said (Continued)

liquid crystal panels out of said rectangular box. The liquid crystal panels can be fixed well in the device during transportation process, and can be removed from the device more easily when necessary.

11 Claims, 2 Drawing Sheets

(56) References Cited

U.S. PATENT DOCUMENTS

| | | | | |
|---|---|---|---|---|
| 8,777,007 | B2 * | 7/2014 | Chen | B65D 81/05 206/454 |
| 9,365,318 | B2 * | 6/2016 | Yue | B65D 85/62 |
| 9,376,251 | B2 * | 6/2016 | Hong | B65D 81/107 |
| 2002/0003101 | A1 * | 1/2002 | Sembonmatsu | H01L 21/67333 206/726 |
| 2006/0226047 | A1 * | 10/2006 | Takagi | B65D 85/48 206/725 |
| 2011/0049000 | A1 * | 3/2011 | Ishibashi | B65D 81/053 206/521 |
| 2013/0032505 | A1 * | 2/2013 | Hu | B65D 81/022 206/524.6 |
| 2013/0306514 | A1 * | 11/2013 | Hu | B65D 81/053 206/586 |
| 2014/0001085 | A1 * | 1/2014 | Zhao | B65D 85/30 206/722 |
| 2014/0262927 | A1 | 9/2014 | Guo et al. | |

FOREIGN PATENT DOCUMENTS

| | | | |
|---|---|---|---|
| CN | 203111793 | U | 8/2013 |
| CN | 103359408 | A | 10/2013 |
| CN | 203473600 | U | 3/2014 |
| CN | 203512373 | U | 4/2014 |
| JP | 2003-264225 | A | 9/2003 |
| JP | 2005-082206 | A | 3/2005 |
| KR | 10-2011-0063993 | A | 6/2011 |

OTHER PUBLICATIONS

International Search Report (Form PCT/ISA/210) and the Written Opinion (Form PCT/ISA/237) issued on Mar. 17, 2015, by the State Intellectual Property Office of China acting as the International Searching Authority in corresponding International Application No. PCT/CN2014/082373. (8 pages).

* cited by examiner

PACKAGE BOX DEVICE FOR LIQUID CRYSTAL PANELS

FIELD OF THE INVENTION

The present disclosure relates to the technical field of an auxiliary device for liquid crystal displays, and particularly to a package box device for transporting or transferring liquid crystal glass panels.

BACKGROUND OF THE INVENTION

During the process of producing, manufacturing or assembling liquid crystal panels 2' (usually as liquid crystal glass panels), the substrates, semi-finished products or finished products of liquid crystal panels 2' need to be transported or transferred among different working stations or workshops. A package box 1' is usually used for accommodating the substrates, semi-finished products or finished products of liquid crystal panels 2' during transportation or transfer. FIG. 4 shows the structure of a package box 1' usually used in the prior art. As shown in FIG. 4, the package box 1', with a rectangular structure, is usually made of foaming materials, such as EPP (expanded polypropylene) or EPO (a copolymer consisting of 30 wt % polyethylene and 70 wt % polystyrene). The inside surfaces of the package box 1' are formed by a plurality of uneven lattices, so as to provide a cushioning effect during transportation or transfer. In addition, the bottom of the package box 1' comprises four or eight supporting blocks generally, and has a certain thickness to provide a cushioning effect during transportation or transfer.

The liquid crystal panels 2' are put into said package box 1' before being transported or transferred, as shown in FIG. 5. The liquid crystal panels 2' are put into said package box 1' in a stack, and then packaged and transported. However, the foaming materials, such as EPP or EPO, would expand or shrink with the changes of the temperature of the environment. Therefore, when a package box 1', made of EPP or EPO and filled with liquid crystal panels 2', is transported from an environment with a relatively high temperature to an environment with a relatively low temperature, the size of the package box 1' would shrink with the change of the temperature of outside environment owing to shrinkage of foaming materials, i.e., EPP or EPO, and the inner size of the package box 1' would become smaller accordingly. After the package box 1' filled with liquid crystal panels 2' is transported to its destination, the liquid crystal panels 2' should be removed from the package box 1'. However, because of the shrinkage of the package box 1', the liquid crystal panels 2' would be stuck in the package box 1' and cannot be removed smoothly, even causing the liquid crystal panels 2' broken during removal.

SUMMARY OF THE INVENTION

The technical problem to be solved by the present disclosure is providing a package box device for liquid crystal panels, which can secure the liquid crystal panels well during transportation, and from which the liquid crystal panels can be removed more easily.

In order to solve the aforesaid technical problem, the present disclosure provides a package box device for liquid crystal panels comprising a rectangular box for accommodating liquid crystal panels, wherein an inside surface of said rectangular box inclines to such a direction that an upper opening of the box is larger than a bottom surface thereof, and an inside surface opposite to said inclined inside surface of said rectangular box is provided with a detachable member; and wherein said detachable member is constructed so that after said detachable member is installed, said detachable member protrudes toward said inclined inside surface to fix liquid crystal panels to be transported, and after said detachable member is detached, the upper opening of said rectangular box becomes larger to facilitate removal of said liquid crystal panels out of said rectangular box.

Compared with the prior art, the package box device for liquid crystal panels according to the present disclosure has the following advantages. One inside surface of said package box device is arranged as an inclined surface, and another inside surface of said rectangular box opposite to said inclined inside surface is provided with a detachable member. The liquid crystal panels are placed into the rectangular box of said package box device before transportation or transfer, and then the detachable member is installed. After the detachable member is installed, the detachable member protrudes toward said inclined inside surface, thereby shortening the effective movable distance of the liquid crystal panels located between the two opposite inside surfaces. That is to say, because of the existence of the protruding detachable member, the opposite sides of liquid crystal panels abut against the inclined inside surface and the face of the detachable member respectively, thus fixing the liquid crystal panels. When the liquid crystal panels need to be removed, the detachable member is detached first. Under the circumstances, because of the detachable member being detached, the rectangular box can provide an accommodating space slightly larger than the size of liquid crystal panels even if the rectangular box shrinks owing to low temperature. In particular, when the liquid crystal panels are removed from the upside of the rectangular box, the upper opening of the box becomes large owing to the existence of the inclined inside surface, so that the liquid crystal panels can be removed from the rectangular box easily.

In one embodiment, after said detachable member is installed on said inside surface opposite to said inclined inside surface, an inclining angle of an inward-inclining face of said detachable member facing said liquid crystal panels is not less than an inclining angle of said inclined inside surface. Because the inclining angle of the inward-inclining face of said detachable member after the detachable member is installed is not less than the inclining angle of the inclined inside surface, the detachable member and the inclined inside surface can cooperate with each other to prevent the liquid crystal panels from moving upwardly or horizontally during transportation, thus fixing the liquid crystal panels better. As well known, the inclining angle of the inward-inclining face of the detachable member and the inclining angle of the inclined inside surface are both within 90° in practical use; otherwise, it would be inconvenient for packaging the liquid crystal panels. In addition, the inclining angle of the inward-inclining face of the detachable member and the inclining angle of the inclined inside surface cannot be too small, less than 10° for example; otherwise, the above fixing effect would be insignificant.

In one preferred embodiment, after said detachable member is installed, said inward-inclining face thereof is parallel to said inclined inside surface. That is to say, during the installing process of the detachable member, the inclining angle of the inward-inclining face thereof equals to the inclining angle of the inclined inside surface. In this way, it is easy to check whether the detachable member is installed in a correct way. In addition, even if the rectangular box shrinks to a relatively large extent owing to low temperature, the liquid crystal panels can be easily packaged without being squeezed through adjusting the location of the detachable member along the vertical direction. Moreover, before the liquid crystal panels are removed from the rectangular box, the detachable member can be removed easily because it is not squeezed by the liquid crystal panels.

In one embodiment, an angle formed by said inclined inside surface and a longitudinal direction of said rectangular box ranges from 15° to 45°, and an angle formed by said inward-inclining face of said detachable member, after being installed to said rectangular box, and a longitudinal direction of said rectangular box ranges from 15° to 45°. On the one hand, if the angles are too small, the liquid crystal panels cannot be removed from the rectangular box easily when the rectangular box shrinks owing to low temperature. On the other hand, if the angles are too large, larger than 60° for example, for the rectangular box with the same exterior size as the rectangular box in the prior art, the thickness of the bottom thereof need to be made thicker to accommodate the liquid crystal panels with the same size. Therefore, the number of liquid crystal panels that can be put in the box is reduced, and the transportation or turnover efficiency of the liquid crystal panels is reduced accordingly. With the angles ranging from 15° to 45°, after the detachable member is detached, the accommodating space of the rectangular box is relatively large. As a result, the liquid crystal panels can be removed from the rectangular box conveniently, and at the same time, the efficiency of transportation can be ensured.

In one embodiment, said inside surface opposite to said inclined inside surface is provided with a groove, and said detachable member, on its inserting side, is provided with a protrusion cooperating with said groove for limiting said detachable member. The groove and protrusion cooperate with each other, so that insertion and removal of the detachable member relative to the inside surface opposite to said inclined inside surface can be achieved. Meanwhile, the two structures of groove and protrusion, cooperating with said groove for limiting said detachable member, both can be manufactured easily, and the manufacturing cost thereof is reduced accordingly. Furthermore, the structure thereof is simple and durable, and the connection obtained is more reliable with long service life.

In one preferred embodiment, said groove is formed as a trapezoid with a relatively small top near to said liquid crystal panels and a relatively large base away from said liquid crystal panels. The groove, with a trapezoid shape, cooperates with the protrusion of the detachable member after the detachable member is installed to the rectangular box, so that the detachable member can be secured by the top of the trapezoid of the groove, and cannot slide out along the horizontal direction easily. At the same time, the groove and the detachable member jointly limit the detachable member in the vertical direction. Especially under the action of gravity, the detachable member is pressed in the groove, so that the connection between the detachable member and the groove is relatively reliable. The detachable member can be removed from the groove only through upward moving it by tools or manual labor when necessary.

In one embodiment, said groove extends downwards from a top portion of said inside surface opposite to said inclined inside surface, with an extending depth thereof ranging from 3 cm to 8 cm. The depth is conducive to the fixing of the detachable member, and the detachable member cannot slide out easily after being inserted into the groove. At the same time, the detachable member can be detached conveniently when necessary with the aforesaid depth.

In one preferred embodiment, said detachable member is structured as a connector with a stop protrusion provided on a middle part of its back and an inward-inclining face formed on its front, and a bottom surface of said rectangular box is provided with a slot for accommodating the lower part of said detachable member. In practical use, the detachable member can be provided with a stop protrusion on one lateral surface, or be provided with two stop protrusions on two lateral surfaces respectively. For example, the detachable member can be provided with two wings on two lateral surfaces respectively. However, compared with a detachable member with two wings provided on its two lateral surfaces respectively, a detachable member with a protrusion provided on a middle part of its back can be processed more conveniently and easily. In addition, a detachable member with a protrusion provided on a middle part of its back can be installed more conveniently. Preferably, the material of the inward-inclining face of the detachable member is the same as the material of the rectangular box or the inside surface opposite to said inclined inside surface, such as EPP or EPO. However, the inward-inclining face of the detachable member can be made of other materials different from the material of the rectangular box. Theoretically, the inward-inclining face of the detachable member can be made of any material which can provide cushioning effect when contacting with liquid crystal panels. In addition, since the protrusion provided on the back of the detachable member does not contact with liquid crystal panels, such protrusion can be made of material the same as the material of the inward-inclining face of the detachable member, or can be made of materials different from the material of the inward-inclining face of the detachable member.

In one embodiment, said inside surface opposite to said inclined inside surface is provided with a clamping part, and said detachable member is provided with a clamp to cooperate with said clamping part for locking said detachable member. Preferably, the clamping part and clamp can both be made of materials different from the material of the rectangular box. For example, the rectangular box is made of EPP (expanded polypropylene) or EPO (a copolymer consisting of 30 wt % polyethylene and 70 wt % polystyrene), while the clamping part and clamp are both made of metal, which has the benefits of not being deformed or damaged easily, with good abrasion resistance.

In one preferred embodiment, said detachable member, on its upper end, is provided with a structure for facilitating removal of said detachable member, and said structure is one or more selecting from a group consisting of groove, hole and ring. For example, in one embodiment, the structure for facilitating removal of said detachable member conveniently can be arranged as a groove structure or a through hole structure through which the detachable member can be removed by tools or manual labor conveniently. The through hole structure is generally provided on the upper end of the inward-inclining face of the detachable member, with a size that can facilitate removing the detachable member from the groove by manual labor or tools, a hook for example. In another embodiment, the structure for taking out said detachable member conveniently may be hanging ring or other ring structure. In general, the hanging ring or other ring structure is provided on the top surface of the detachable member. Preferably, the hanging ring or other ring structure can be folded. In this way, the hanging ring or other ring structure can be folded or hidden on the top surface of the detachable member when it is not needed, which can save space and facilitate package. When the detachable member needs to be detached, the hanging ring or other ring structure is pulled out, so that the detachable member is detached conveniently. Of course, the detachable member can be provided with one structure or a group of structures for facilitating removal of said detachable member, such as through hole and ring structure.

DETAILED DESCRIPTION OF THE EMBODIMENTS

The present disclosure will be further illustrated hereinafter in combination with the drawings and embodiments.

Figure 1:
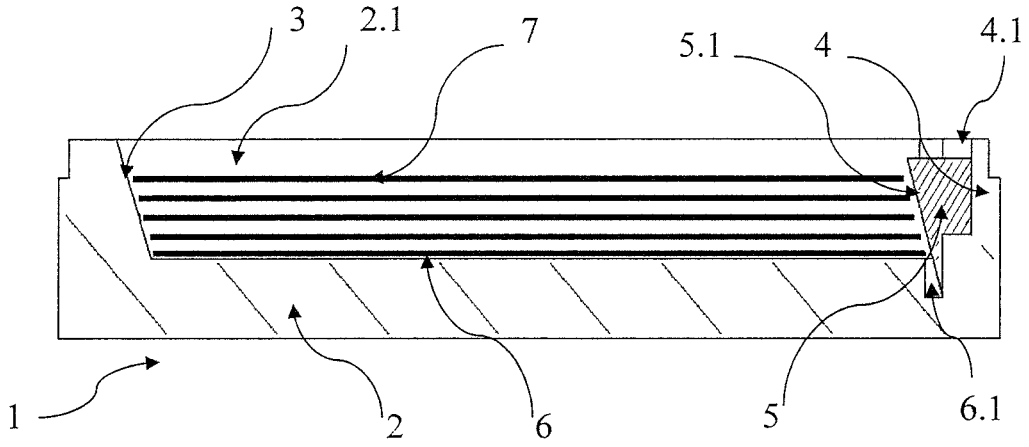
FIG. 1 is a sectional view of a package box device for liquid crystal panels according to an embodiment of the present disclosure, with a detachable member being mounted therein.
Figure 2:
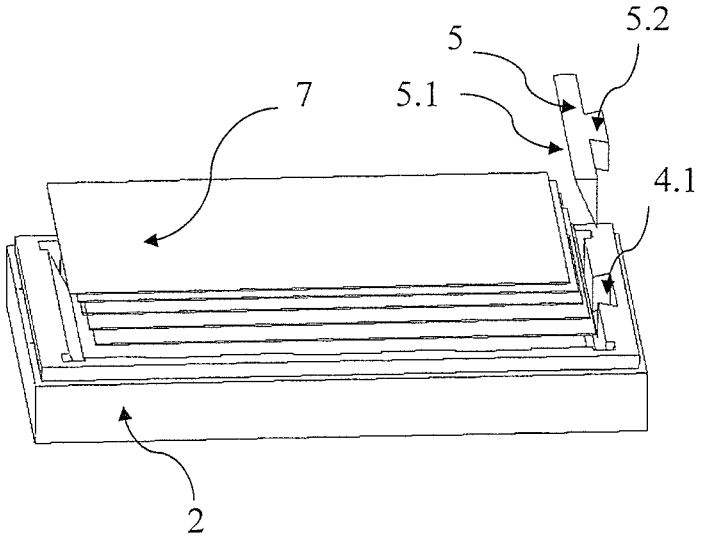
FIG. 2 schematically shows a perspective diagram of the package box device for liquid crystal panels of FIG. 1, with said detachable member not being installed therein.
Figure 3:
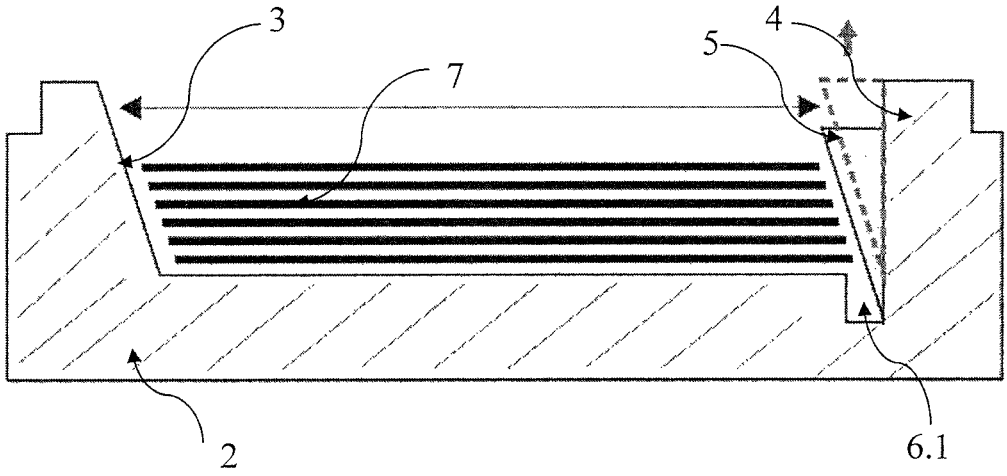
FIG. 3 is a sectional view of the package box device for liquid crystal panels shown in FIG. 2 when a detachable member is being installed therein.
Figure 4:
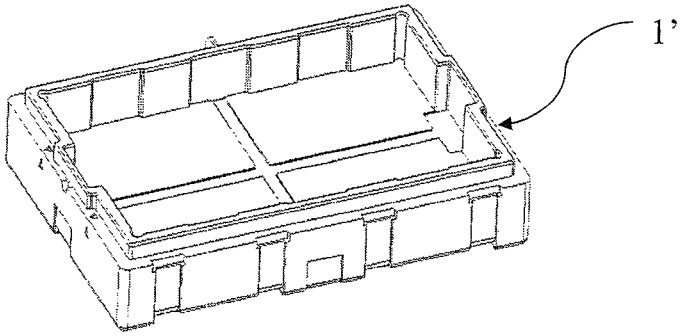
FIG. 4 schematically shows a perspective diagram of a package box for liquid crystal panels in the prior art.
Figure 5:
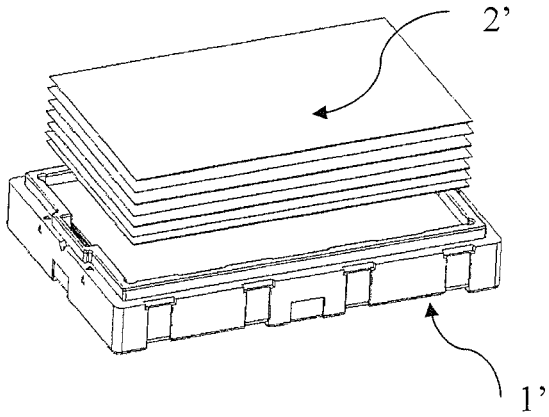
FIG. 5 schematically shows the package box for liquid crystal panels of FIG. 4 when the liquid crystal panels are removed from the package box.

In a package box device for liquid crystal panels according to an embodiment of the present disclosure, as shows in FIG. 1 to FIG. 3, the package box device 1 for liquid crystal panels comprises a rectangular box 2 for accommodating liquid crystal panels 7, wherein an inside surface 3 of said rectangular box 2 inclines to such a direction that an upper opening 2.1 of the rectangular box 2 becomes large, and an inside surface 4 opposite to said inclined inside surface 3 of said rectangular box 2 is provided with a detachable member 5. To prevent the situation that liquid crystal panels 7 cannot be removed or cannot be removed from the rectangular box 2 easily as a result of the fact that the rectangular box 2 shrinks owing to low temperature, said detachable member 5 is configured so that the liquid crystal panels 7 can be put into the rectangular box 2 before transportation, and then the detachable member 5 is installed on the inside surface 4 opposite to said inclined inside surface 3 of said rectangular box 2; and the detachable member 5 protrudes toward the inclined inside surface 3 (i.e., inwardly), so that an inward-inclining face 5.1 of the detachable member 5 and the inclined inside surface 3 jointly secure the liquid crystal panels 7 from two sides. In addition, as shown in FIG. 3, when the liquid crystal panels 7 are removed, the detachable member 5 is detached first, so that the upper opening 2.1 of the rectangular box 2 becomes large, and the accommodation space of the rectangular box 2 becomes large accordingly. During the process of the liquid crystal panels 7 being lifted from the bottom to the upper opening 2.1 of the rectangular box 2, because of the area of the upper opening 2.1 being large, the higher the liquid crystal panels 7 are lifted, the smaller the probability of the liquid crystal panels 7 touching the rectangular box 2 will become. Therefore, the liquid crystal panels 7 can be removed from the rectangular box 2 more easily. In this manner, the defect existing in the prior art, i.e., the space between the inclined inside surface 3 and the inside surface 4 opposite to said inclined inside surface 3 becomes smaller owing to shrinkage of the rectangular box 2, and consequently the liquid crystal panels 7 cannot be taken out of the rectangular box 2 easily, is overcome.

In one embodiment, after said detachable member 5 is installed on said inside surface 4 opposite to said inclined inside surface 3, an inclining angle of the inward-inclining face 5.1 of said detachable member facing said liquid crystal panels is not less than an inclining angle of said inclined inside surface 3. In the embodiment shown in FIG. 1, an inclining angle of the inclined inside surface 3 is an angle formed by the inclined inside surface 3 and a longitudinal direction or a vertical direction. In one preferred embodiment, an inclining angle of the inclined inside surface 3 ranges from 15° to 45°. If the inclining angle is too small, it would be difficult to remove the liquid crystal panels 7 from the rectangular box 2 when the rectangular box 2 shrinks to a large extent owing to low temperature. If the inclining angle is too large, the size of the rectangular box 2 has to be enlarged or a bottom 6 thereof has to be lifted to accommodate the liquid crystal panels 7 with the same size. If the bottom 6 of the rectangular box 2 is lifted, the number of the liquid crystal panels 7 therein would decrease inevitably. Thus the number of liquid crystal panels 7 that can be put in one package box decreases, and the transporting efficiency is reduced accordingly.

In addition, the distance between the inclined inside surface 3 of the rectangular box 2 and the inward-inclining face 5.1 can be adjusted by adjusting the inserting depth of the detachable member 5. In this manner, the rectangular box 2 is applicable to liquid crystal panels 7 with different sizes, or the liquid crystal panels 7 being stuck in the rectangular box 2 when the rectangular box 2 shrinks can be prevented. Preferably, an angle formed by the inward-inclining face 5.1 of the detachable member 5, after being installed to the rectangular box 2, and a longitudinal direction of the rectangular box 2 ranges from 15° to 45°.

In one preferred embodiment, the inward-inclining face 5.1 of the detachable member 5 after being installed to the rectangular box 2, and the inclined inside surface 3 are parallel to each other, as shown in FIG. 3. In this way, the size of the accommodating space of the rectangular box 2 can be adjusted by adjusting the location of the detachable member 5 along the longitudinal direction according to length of different liquid crystal panels 7.

In one embodiment, as shown in FIG. 1 and FIG. 2, said inside surface 4 opposite to said inclined inside surface 3 is provided with a groove 4.1, and said detachable member 5, on its inserting side, is provided with a protrusion 5.2, which can cooperate with said groove 4.1 for limiting said detachable member. In one preferred embodiment, said groove 4.1 is formed as a trapezoid with a relatively small top near to said liquid crystal panels 7 and a relatively large base away from said liquid crystal panels 7. Correspondingly, the protrusion 5.2 is formed as having a small side near to the inward-inclining face 5.1 and a large side far from the inward-inclining face 5.1. After the protrusion 5.2 is inserted into the groove 4.1 with a trapezoid structure, the protrusion 5.2 can be securely positioned in the trapezoid structure because of the small side of the groove 4.1. Therefore, the detachable member 5 cannot move horizontally relative to the inclined inside surface 3. That is to say, the detachable member 5 can only move from the top down when it is inserted into the groove 4.1, and from the bottom up when it is removed from the groove 4.1. Of course, it is just one of specific inserting structures, and the present disclosure is not limited by the aforesaid inserting structure. Any other inserting structure by which the detachable member 5 can be inserted into and removed from the inside surface 4 opposite to the inclined inside surface 3 can be used herein. For example, the detachable member 5 can be provided with two inserting pieces on its two lateral surfaces, and correspondingly the inside surface 4 opposite to the inclined inside surface 3 is provided with two grooves cooperating with the two inserting pieces respectively.

In one preferred embodiment, said groove 4.1 extends downwards from a top portion of said inside surface 4 opposite to said inclined inside surface 3, with an extending depth thereof ranging from 3 cm to 8 cm. The depth of the groove 4.1 is arranged to be 3 cm to 8 cm, in this manner, not only the detachable member 5, after being installed on said rectangular box 2, can be firmly connected with the rectangular box 2, and would not tilt or swing easily, but also the detachable member 5 can be inserted into and removed from the rectangular box 2 conveniently. In particular, when the depth of the groove 4.1 is more than 15 cm, the processing difficulty thereof increases. Moreover, the detachable member 5 can only be removed from the rectangular box 2 after being lifted more than 15 cm from the top surface of the groove 4.1. That is to say, removing the detachable member 5 is a time consuming and labor consuming process. Of course, it mainly refers to the package box device 1 for transporting the liquid crystal panels 7 with normal sizes. However, in respect of large sized liquid crystal panels 7, for example integrated or entire liquid crystal panels 7 more than 42 inches, the size of the rectangular box 2 thereof is relatively large, and thus the depth of the groove 4.1 may increase accordingly. Under such circumstances, the depth of the groove 4.1 may surpass 15 cm.

Preferably, the material of the detachable member 5 is the same as the material of the rectangular box 2. For example, the detachable member 5 is made of EPP or EPO. The detachable member 5, made of EPP or EPO, can provide relatively excellent cushioning effect. However, the detachable member 5 can be made of other materials which can also provide cushioning effect in addition to EPP and EPO.

In one preferred embodiment, as shown in FIG. 1 and FIG. 2, said detachable member 5 is structured as a connector with a protrusion 5.2 provided on a middle part of its back and an inward-inclining face 5.1 formed on its front, and the bottom surface 6 of said rectangular box 2 is provided with a slot 6.1 for accommodating the lower part of said detachable member 5. Generally, the width of the slot 6.1 is larger than the width of the lower part of the detachable member 5. In this way, a gap is left after the lower part of the detachable member 5 is inserted into the slot 6.1 of the bottom surface 6. As a result, the resistance exerting on the detachable member 5 when it is removed from the rectangular box 2 is reduced. In addition, since the protrusion 5.2 being provided on the back of the detachable member 5 does not contact with the liquid crystal panels 7, the protrusion can be made of materials different from the material of the rectangular box 2, such as metals or other hard materials. If the protrusion 5.2 is made of metals or other hard materials, the groove 4.1 should be made of wear resistance materials accordingly, thereby the damage to the groove 4.1 when the protrusion 5.2 is inserted into it being avoided.

In one embodiment not shown, said inside surface 4 opposite to said inclined inside surface 3 is provided with a clamping part, and said detachable member 5 is provided with a clamp to cooperate with said clamping part for locking said detachable member. Preferably, the clamp of the detachable member 5 and the clamping part of the inside surface 4 opposite to the inclined inside surface 3, coordinating with each other for locking the detachable member 5, can be designed with a structure similar to the structure of the safety belt of vehicles. The structure, similar to the structure of the safety belt of vehicles, is locked when the clamp is inserted into the clamping part. The clamp is provided with a press-button on its upper end, and the clamp is removed from the clamping part when the press-button is pressed. Of course, any structure by which the detachable member 5 can be locked into and removed from the rectangular box 2 conveniently can be used herein.

In one embodiment not shown, preferably, the detachable member 5, on its upper end, is provided with a structure for facilitating removal of the detachable member 5. For example, the structure for removing the detachable member 5 conveniently may be arranged as a groove structure or a through hole structure provided on the upper end of the detachable member 5 through which the detachable member 5 can be removed by tools or manual labor, and may be hanging ring or other ring structure provided on the upper end of the detachable member 5. And preferably, the hanging ring or other ring structure can be folded. In this way, the hanging ring or other ring structure can be folded or hidden on the top surface of the detachable member 5 when it is not needed, which can save space and facilitate package.

The present disclosure is explained in detail in combination with specific examples hereinabove, but it is understandable that the embodiments herein can be improved or substituted without departing from the protection scope of the present disclosure. In particular, as long as there are no structural conflicts, the technical features disclosed in each and every embodiment of the present disclosure can be combined with one another in any way, and the combined features formed thereby are within the protection scope of the present disclosure. The present disclosure is not limited by the specific embodiments disclosed herein, but includes all technical solutions falling into the protection scope of the claims.

The invention claimed is:

1. A package box device for liquid crystal panels, comprising a rectangular box for accommodating liquid crystal panels, wherein an inside surface of said rectangular box inclines to such a direction that an upper opening of the box is larger than a bottom surface thereof, and an inside surface opposite to said inclined inside surface of said rectangular box is provided with a detachable member; and wherein said detachable member is constructed so that after said detachable member is installed, said detachable member protrudes toward said inclined inside surface to fix liquid crystal panels to be transported; and after said detachable member is detached, the upper opening of said rectangular box becomes larger to facilitate removal of said liquid crystal panels out of said rectangular box, wherein said inside surface opposite to said inclined inside surface is provided with a groove, and said detachable member, on its inserting side, is provided with a protrusion cooperating with said groove for limiting said detachable member, and said detachable member is structured as a connector with a stop protrusion provided on a middle part of its back and an inward-inclining face formed on its front, and the bottom surface of said rectangular box is provided with a slot for accommodating the lower part of said detachable member.

2. The device according to claim 1, wherein after said detachable member is installed on said inside surface opposite to said inclined inside surface, an inclining angle of an inward-inclining face of said detachable member facing said liquid crystal panels is not less than an inclining angle of said inclined inside surface.

3. The device according to claim 2, wherein after said detachable member is installed, said inward-inclining face thereof is parallel to said inclined inside surface.

4. The device according to claim 3, wherein an angle formed by said inclined inside surface and a longitudinal direction of said rectangular box ranges from 15° to 45°, and an angle formed by said inward-inclining face of said detachable member, after being installed to said rectangular box, and a longitudinal direction of said rectangular box ranges from 15° to 45°.

5. The device according to claim 1, wherein said groove is formed as a trapezoid with a relatively small top near to said liquid crystal panels and a relatively large base away from said liquid crystal panels.

6. The device according to claim 5, wherein said groove extends downwards from a top portion of said inside surface opposite to said inclined inside surface, with an extending depth thereof ranging from 3 cm to 8 cm.

7. The device according to claim 1, wherein said inside surface opposite to said inclined inside surface is provided with a clamping part, and said detachable member is provided with a clamp to cooperate with said clamping part for locking said detachable member.

8. The device according to claim 2, wherein said inside surface opposite to said inclined inside surface is provided with a clamping part, and said detachable member is provided with a clamp to cooperate with said clamping part for locking said detachable member.

9. The device according to claim 3, wherein said inside surface opposite to said inclined inside surface is provided with a clamping part, and said detachable member is provided with a clamp to cooperate with said clamping part for locking said detachable member.

10. The device according to claim 4, wherein said inside surface opposite to said inclined inside surface is provided with a clamping part, and said detachable member is provided with a clamp to cooperate with said clamping part for locking said detachable member.

11. The device according to claim 1, wherein said detachable member, on its upper end, is provided with a structure for facilitating removal of said detachable member, and said structure is one or more selecting from a group consisting of groove, hole and ring.

* * * * *